US007959222B1

(12) United States Patent
Powell et al.

(10) Patent No.: US 7,959,222 B1
(45) Date of Patent: Jun. 14, 2011

(54) CHAIR DEVICE FOR ACCOMMODATING STOMACH, NECK, AND BODY

(76) Inventors: Annitta L. Powell, Wallace, NC (US); Randy C. Ingram, Wallace, NC (US)

( * ) Notice: Subject to any disclaimer, the term of this patent is extended or adjusted under 35 U.S.C. 154(b) by 72 days.

(21) Appl. No.: 12/437,501

(22) Filed: May 7, 2009

(51) Int. Cl.
*A47C 17/66* (2006.01)

(52) U.S. Cl. ..... 297/188.06; 297/403; 297/900; 5/111; 5/638; 5/725

(58) Field of Classification Search ..... 297/188.04, 297/188.05, 188.06, 397, 403, 900; 5/110, 5/111, 638, 656, 725, 735
See application file for complete search history.

(56) References Cited

U.S. PATENT DOCUMENTS

| | | | | |
|---|---|---|---|---|
| 3,351,312 | A * | 11/1967 | Ballas | 248/448 |
| 3,897,102 | A * | 7/1975 | Lemaire | 5/656 |
| 4,867,407 | A * | 9/1989 | Becker | 248/444.1 |
| 5,466,039 | A * | 11/1995 | Umbrianna | 297/116 |
| 5,829,080 | A * | 11/1998 | Robillard et al. | 5/638 |
| 5,946,749 | A | 9/1999 | Sewell | |
| 5,950,259 | A * | 9/1999 | Boggs | 297/900 |
| 6,068,342 | A | 5/2000 | Mariani et al. | |
| 6,295,668 | B1 * | 10/2001 | Nation | 5/110 |
| D450,942 | S | 11/2001 | Jones | |
| 6,370,714 | B1 | 4/2002 | Elzenbeck | |
| 6,840,580 | B2 | 1/2005 | Rodriguez | |
| 6,860,567 | B1 | 3/2005 | Bauer | |
| 6,938,287 | B1 * | 9/2005 | Mahshie | 297/900 |
| D527,554 | S | 9/2006 | Jones | |
| 2008/0179933 | A1 | 7/2008 | Puccio | |

OTHER PUBLICATIONS www.downunderchicago.com; ergo lounger; Internet; as of Jul. 8, 2008.
www.amazon.com; ergo lounger; internet; as of Jul. 8, 2008.
www.painreliever.com; ergo lounger; Internet; as of Jul. 8, 2008.
www.painreliever.com; ergo lounger; Internet; as of Jan. 18, 2011.
www.theergolounger.com; ergo lounger; Internet; as of Jan. 18, 2011.

* cited by examiner

*Primary Examiner* — Peter R. Brown

(57) ABSTRACT

A chair device for providing comfort to a individual such as a pregnant woman comprising a first, second, and third panel, wherein the first panel is pivotally connected to the second panel and the third panel is pivotally connected to the second panel opposite the first panel; legs for supporting the panels; a first hole disposed in the second panel for accommodating a user's stomach (a pregnant woman's stomach) when she lies on her stomach; a second hole disposed in the first panel for accommodating the user's face; a shelf hanging downwardly from and generally parallel to a bottom surface the first panel, wherein the shelf may be used as a book shelf, wherein the shelf is attached via an attachment means; the shelf can move between first position where the shelf hangs below the bottom surface of the first panel and a second position where the shelf flipped over a top surface of the first panel.

2 Claims, 7 Drawing Sheets

CHAIR DEVICE FOR ACCOMMODATING STOMACH, NECK, AND BODY

FIELD OF THE INVENTION

The present invention is directed to a chair having one or more holes for accommodating a users stomach and/or face when he/she lies on his/her stomach. More particularly, the chair device comprises a book holding apparatus for allowing the user to read while lying on his/her stomach.

BACKGROUND OF THE INVENTION

When an individual is pregnant or is overweight, it can be particularly uncomfortable to lie on his/her stomach. The present invention features a chair device comprising a hole for accommodating the user's stomach and a hole for accommodating the user's face. This can allow for a more comfortable position when the user lies on his/her stomach. The chair device further comprises a shelf that can be used for reading purposes or as a head rest. The chair device may be used by any individual.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
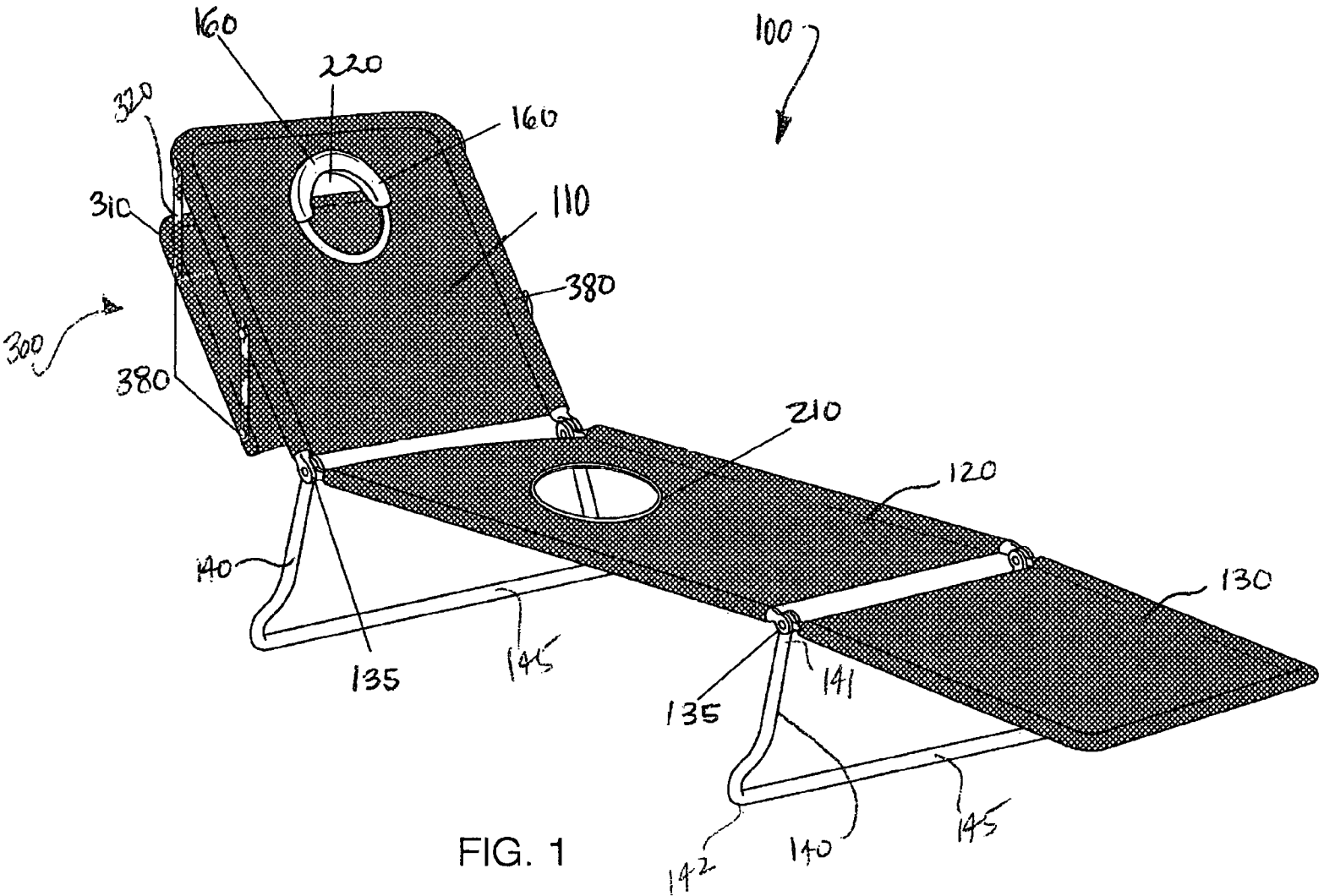
FIG. 1 is a perspective view of the chair device of the present invention.
Figure 2:
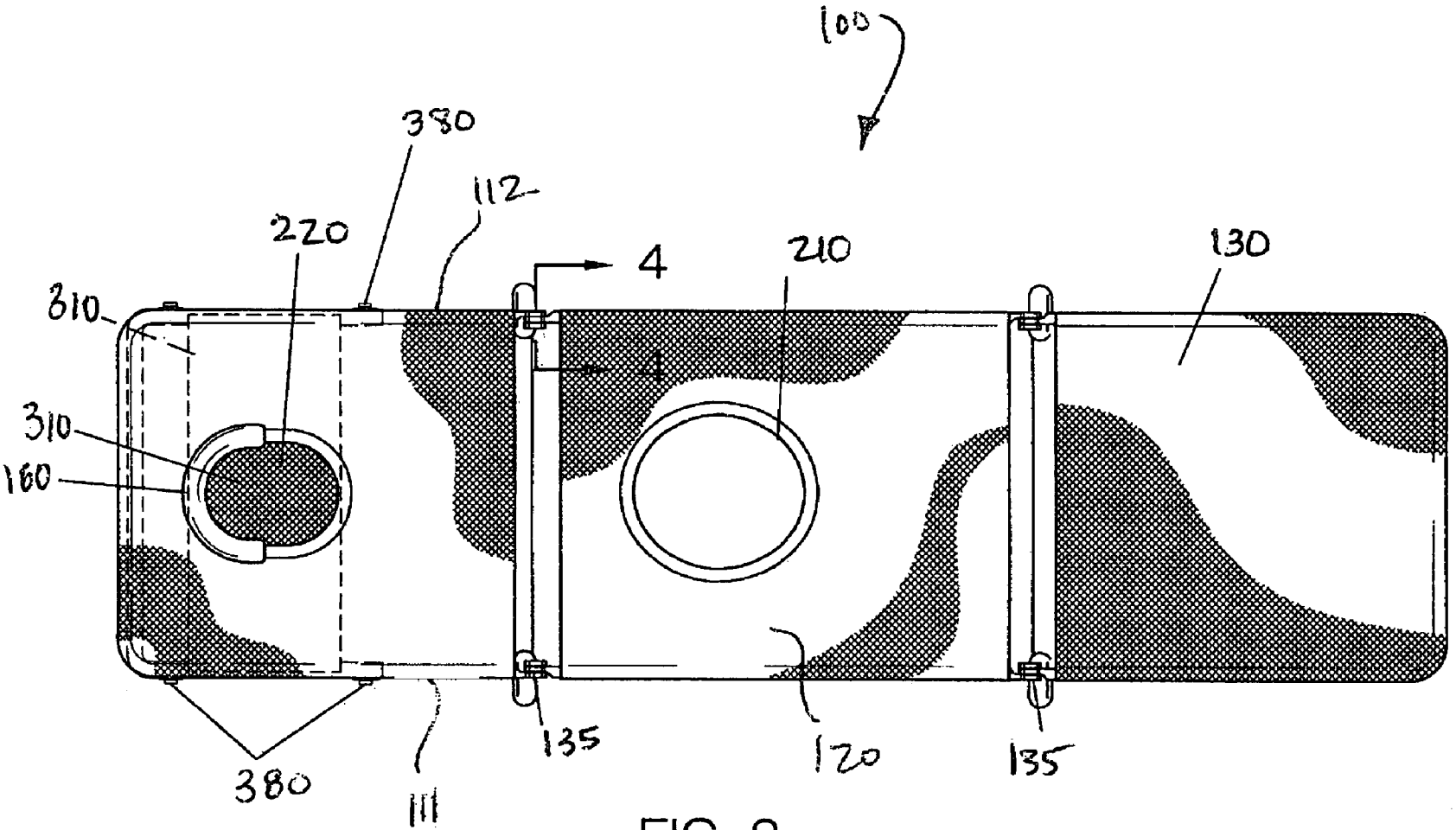
FIG. 2 is a top view of the chair device of the present invention.

The following is a listing of numbers corresponding to a particular element refer to herein:

100 chair device
105 pregnant woman
106 stomach of pregnant woman
107 face of pregnant woman
109 book
110 first panel
111 first side edge of first panel
112 second side edge of first panel
114 top surface of first panel
115 bottom surface of first panel

120 second panel
130 third panel
135 ratchet hinge
136 pin
137 ratchet component
140 legs of chair device
141 first end of leg
142 second end of leg
145 crossbar
160 cushion component
210 first hole
220 second hole
300 book holding apparatus
310 shelf
320 strap
321 first end of strap
322 second end of strap
325 button hole in strap
380 button Referring now to FIGS. 1-5, the present invention features a chair device 100 for providing comfort to a pregnant woman 105 or other individuals such as handicapped individuals. The chair device 100 is not limited to use by a woman or by a handicapped individual, but may be used by anyone. In some embodiments, the chair device 100 can help a user read a book or other piece of reading material while lying face down on the chair device 100.

The chair device 100 comprises three generally flat panels such as a first panel 110, a second panel 120, and a third panel 130. The panels are connected together and are supported by legs 140. In some embodiments, one or more crossbars 145 connect one more legs for stabilization purposes.

The chair device 100 resembles in shape a standard lawn chair, well known to one of ordinary skill in the art. For example, the first panel 110 is pivotally connected to the second panel 120 and the second panel 120 is pivotally connected to the third panel 130. The panels can be pivoted with respect to each other, similar to the pivoting capabilities of standard lawn chairs. In some embodiments, the panels are pivotally connected to each other via a hinge, such as a ratchet hinge 135. Ratchet hinges are well known to one of ordinary skill in the art. For example, in some embodiments, the ratchet hinge 153 comprises a ratchet component 137 that rotates about a pin 136. In some embodiments, the legs 140 can pivot with respect to the panels so that the legs 140 can be folded. In some embodiments, the panels are constructed from a generally flexible material, for example mesh. In some embodiments, the panels are constructed from a flexible material woven together. Such woven material is well known to one of ordinary skill in the art.

Disposed in the second panel 120 is a first hole 210. The first hole 210 is for accommodating a stomach 106 of a pregnant woman 105 or another individual. For example, the woman 105 or other individual can lie face down on the chair device 100 and allow her stomach 106 to protrude through the first hole 210 (see FIG. 5).

Disposed in the first panel 110 is a second hole 220. The second hole 220 is for accommodating the face 107 of the woman 105 or other individual. For example, the woman 105 can lie face down on the chair device 100 and allow her face 107 to protrude through the second hole 220 (see FIG. 5).

In some embodiments, the first hole 210 is lined with elastic or other flexible material. The elastic or flexible material may provide comfort to the user when he/she places his/her stomach though the first hole 210. In some embodiments, a cushion component 160 is attached to the second hole 220 for providing comfort. For example, a cushion component 160 on the second hole 220 may serve as a pillow.

Attached to the first panel 110 is a book holding apparatus 300 and hanging downwardly (and generally parallel) from the bottom surface 115 of the first panel 110. The book holding apparatus 300 comprises a shelf 310 for supporting a book (or other item). The shelf 310 is attached (e.g., removably attached, pivotally attached) via one or more attachment means. For example, in some embodiments, one or more straps 320 (e.g. flexible straps, semi-flexible straps, semi-rigid straps) connect the shelf 310 to the first panel 110. The straps 320 have a first end 321 and a second end 322, wherein the first end 321 is attached (e.g., removably attached) to the first panel 110 and the second end 322 is attached to the shelf 310. In some embodiments, the straps 320 are attached via one or more buttons 380. For example, a button hole 325 may be disposed in the first end 321 and/or second end 322 of the strap 320, wherein the buttons holes 325 are adapted for fitting snugly around the buttons 380. Buttons 380 may be attached to the first panel 110 (e.g., on the first side 111 and/or second side 112) and/or the shelf 310.

Figure 3:
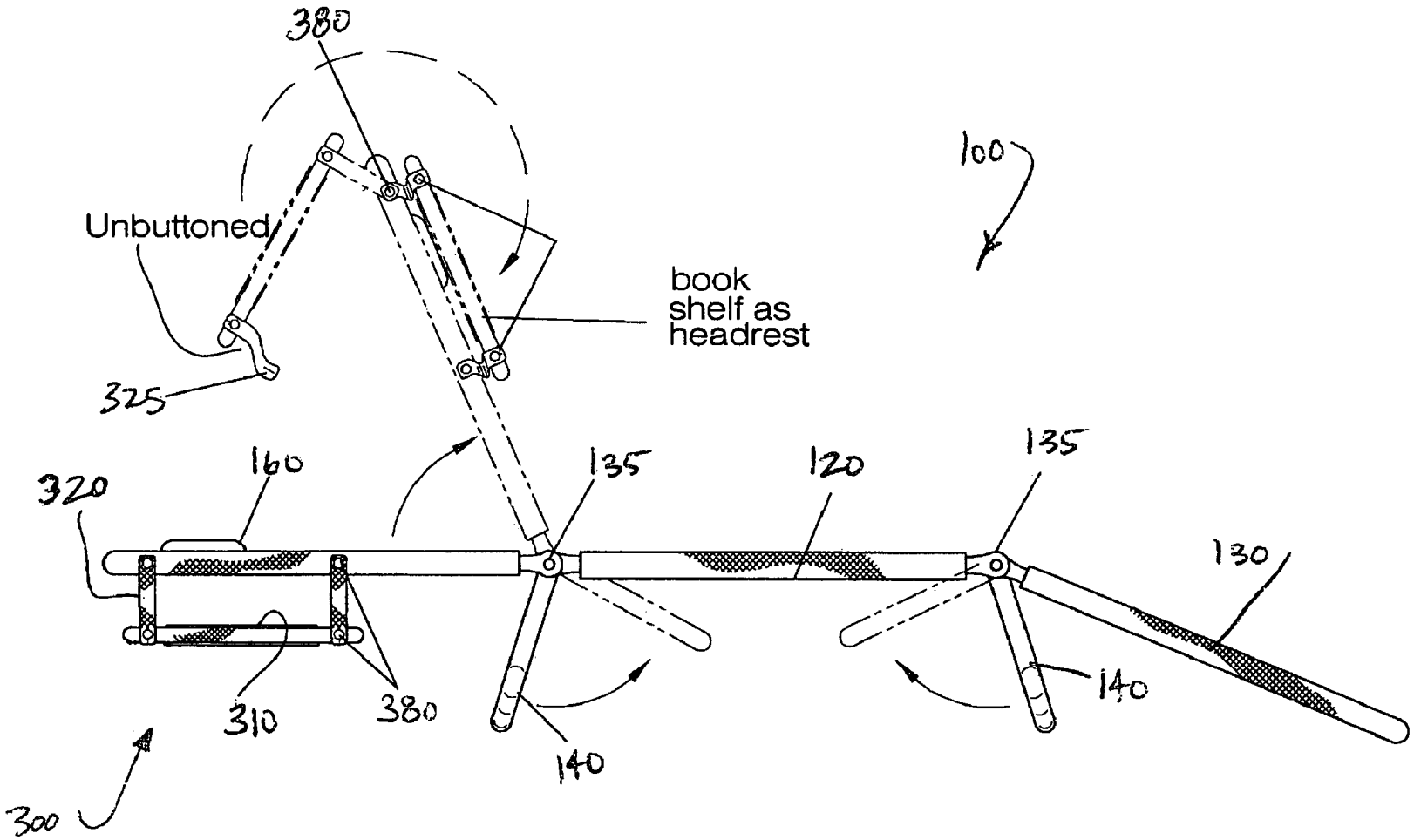
FIG. 3 is a side view of the chair device of the present invention.
Figures 3A, 3B:
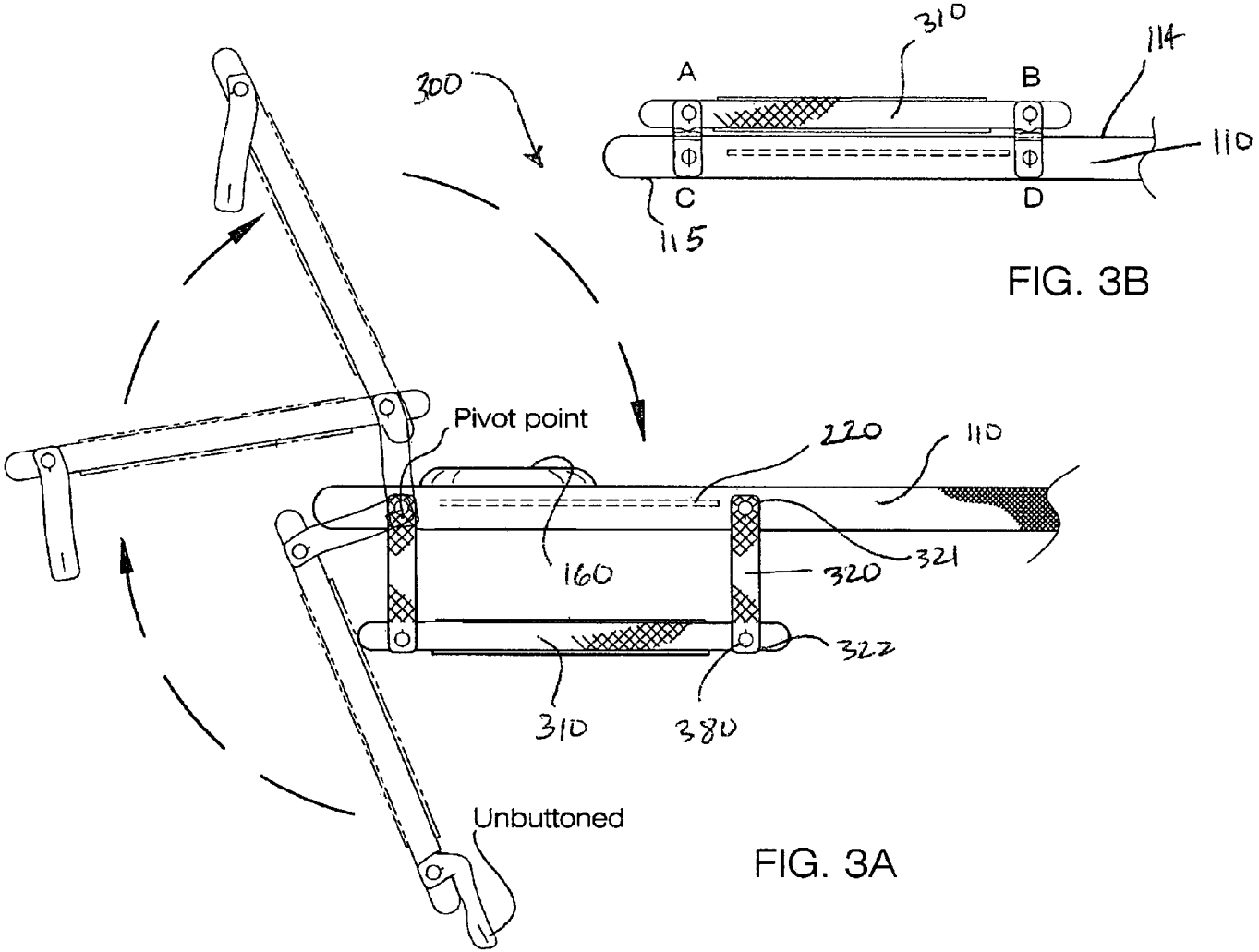
FIG. 3A is a side view of the chair device of the present invention wherein the shelf can be flipped over the top surface of the first panel.
FIG. 3B is a side view of the chair device of the present invention wherein the shelf is used as a headrest.
Figure 4:
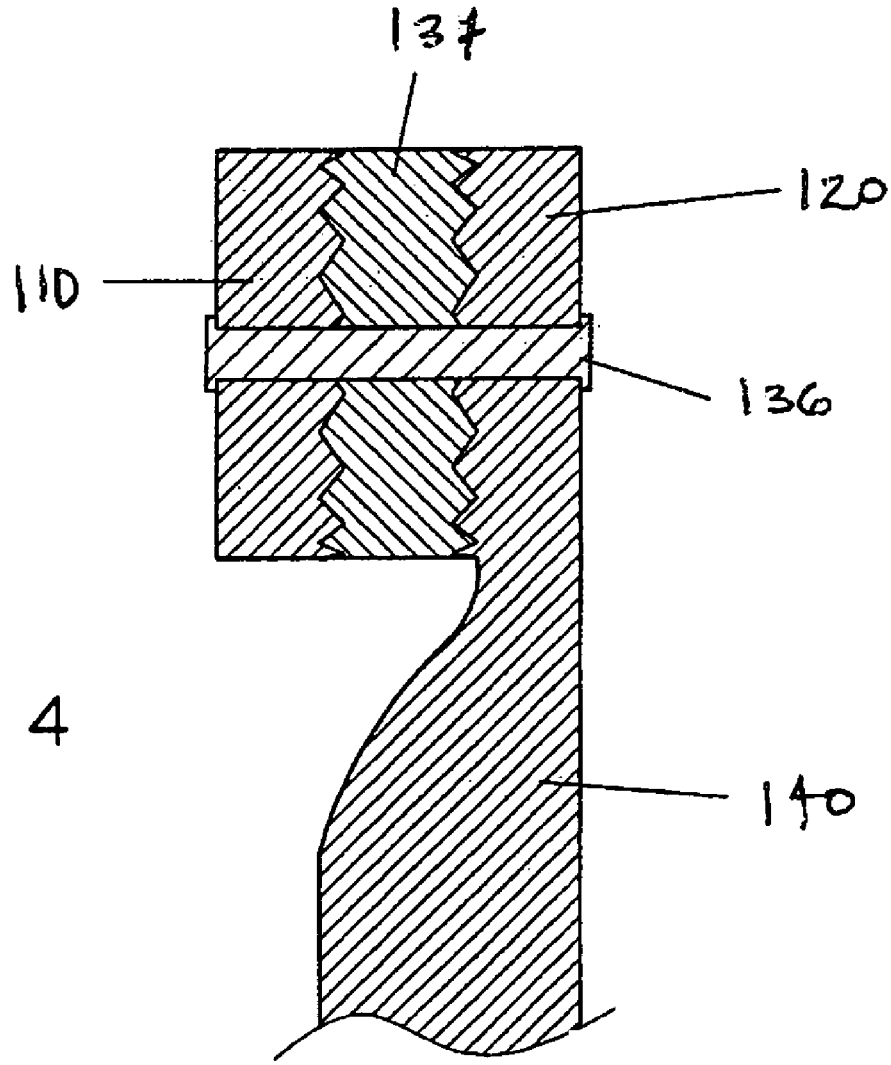
FIG. 4 is a side cross sectional view of a ratchet hinge of the chair device of the present invention.
Figure 5:
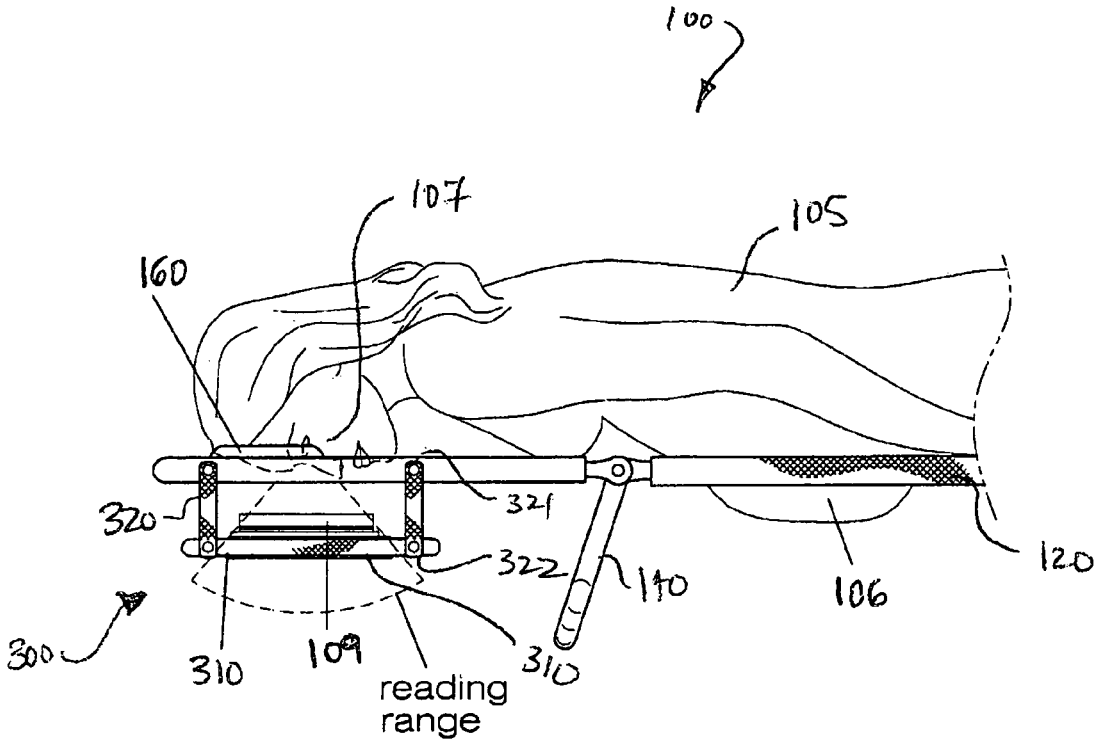
FIG. 5 is a side view of the chair device of the present invention.

The shelf 310 can move between first position (e.g., hanging below the first panel 110) and a second position where the shelf 310 is detached from the straps 320 and flipped over to the top surface 114 of the first panel 110 (see FIG. 3). In some embodiments, the shelf 310 is used as a head rest.

Figure 6:
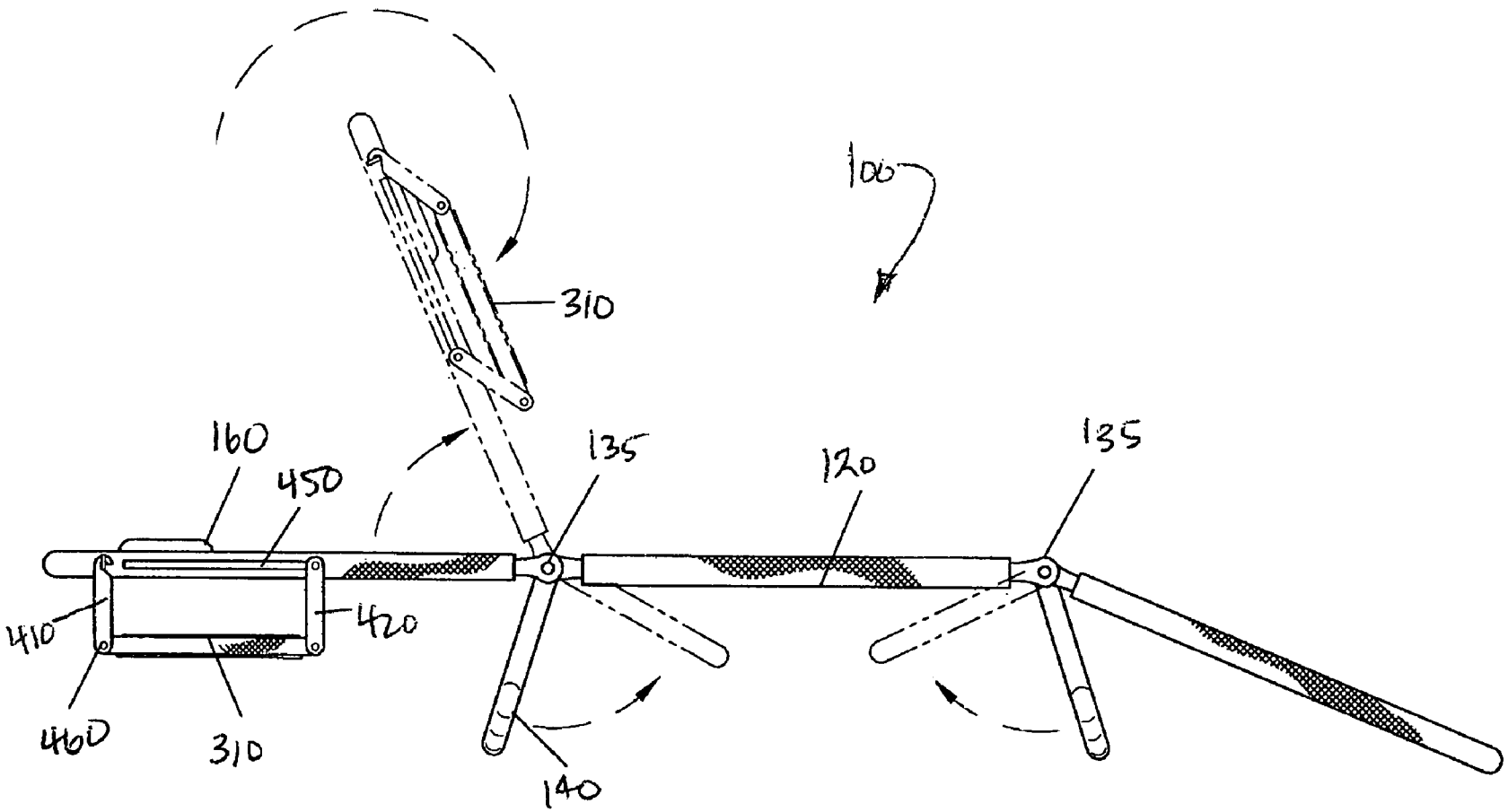
FIG. 6 is an alternate view of a chair device of the present invention having a track design with support bars connecting to the shelf.

In some embodiments, the shelf 310 is attached to the first panel 110 via one or more support bars. For example, in some embodiments, a first support bar 410 and a second support bar 420 disposed on the first side 111 and a third support bar and fourth support bar disposed on the second side 112 (see. FIG. 6). In some embodiments, the support bars are slidably attached to the first panel 110, for example one or more bars can slide backwardly and forwardly within a track 450. The support bars may be pivotally attached to the shelf 310 via a hinge 460. In some embodiments, the first support bar 410 is removably attached to the first panel 110, for example via a hook. A user can unhook the first support bar from the first panel 110 so that the shelf 310 can be flipped over the first panel 110 and used as a head rest.

The chair device 100 may be constructed in a variety of sizes and can be constructed in various heights. For example, in some embodiments, the chair device 100 may is between about 12 to 20 inches in height as measured from the first end 141 of the legs 140 to the second end 142 of the legs 140. In some embodiments, the chair device 100 is between about 20 to 24 inches in height (e.g., 22 inches) as measured from the first end 141 of the legs 140 to the second end 142 of the legs 140. In some embodiments, the chair device 100 is more than about 24 inches in height.

As used herein, the term "about" refers to plus or minus 10% of the referenced number. For example, an embodiment wherein the chair device 100 is about 20 inches in height includes a chair device 100 that is between 18 and 22 inches in height.

The following the disclosures of the following U.S. Patents are incorporated in their entirety by reference herein: U.S. Pat. No. 5,946,749; U.S. Pat. Application No. 2008/0179933; U.S. Pat. No. 6,068,342; U.S. Pat. No. 6,860,567; U.S. Pat. No. 6,840,580; U.S. Pat. No. 6,370,714.

Various modifications of the invention, in addition to those described herein, will be apparent to those skilled in the art from the foregoing description. Such modifications are also intended to fall within the scope of the appended claims. Each reference cited in the present application is incorporated herein: by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A chair device comprising:

(a) a first panel, a second panel, and a third panel, wherein the first panel is pivotally connected to the second panel and the third panel is pivotally connected to the second panel opposite the first panel, wherein the panels are supported by legs;

(b) a first hole disposed in the second panel for accommodating a user's stomach when she lies on her stomach;

(c) a second hole disposed in the first panel for accommodating the user's face;

(d) a shelf hanging downwardly from and generally parallel to a bottom surface of the first panel, the first panel having a head-end and a foot-end, wherein the shelf is attached via an attachment means, the attachment means comprises a strap towards the head-end of the first panel and a strap towards the foot-end of the first panel; the shelf can be moved by the user between first position, where the shelf hangs below the bottom surface of the first panel via the attachment means for the purpose of providing a book shelf, and a second position where the shelf is detached from the first panel by removing the straps, and the shelf is flipped over a top surface of the first panel for the purpose of providing a headrest, wherein for moving the shelf from the first position to a second position, the strap towards the head-end of the first panel remains fastened and the strap towards the foot-end of the panel is unfastened so that the shelf can be flipped over to the top surface.

2. The chair device of claim 1, wherein the straps are removably attached to the first panel and the shelf via a button and button hole mechanism.

* * * * *